US007207862B2

(12) United States Patent
Nabeya et al.

(10) Patent No.: US 7,207,862 B2
(45) Date of Patent: Apr. 24, 2007

(54) POLISHING APPARATUS AND METHOD FOR DETECTING FOREIGN MATTER ON POLISHING SURFACE

(75) Inventors: Osamu Nabeya, Tokyo (JP); Tetsuji Togawa, Tokyo (JP)

(73) Assignee: Ebara Corporation, Tokyo (JP)

( * ) Notice: Subject to any disclaimer, the term of this patent is extended or adjusted under 35 U.S.C. 154(b) by 154 days.

(21) Appl. No.: 10/504,873

(22) PCT Filed: Feb. 27, 2003

(86) PCT No.: PCT/JP03/02233

§ 371 (c)(1),
(2), (4) Date: Feb. 10, 2005

(87) PCT Pub. No.: WO03/072306

PCT Pub. Date: Sep. 4, 2003

(65) Prior Publication Data

US 2005/0130562 A1 Jun. 16, 2005

(30) Foreign Application Priority Data

Feb. 28, 2002 (JP) ..... 2002-053112

(51) Int. Cl.
*B24B 1/00* (2006.01)
*B24B 49/00* (2006.01)
*B24B 51/00* (2006.01)

(52) U.S. Cl. ..... 451/5; 451/8; 451/36; 451/41; 451/59; 451/63; 451/288; 451/290

(58) Field of Classification Search ..... 356/237.1, 356/237.2, 237.3, 237.4, 237.5, 237.6, 394; 382/152, 312; 451/5, 8, 36, 41, 59, 63, 285, 451/286, 287, 288, 289, 290
See application file for complete search history.

(56) References Cited

U.S. PATENT DOCUMENTS

| | | | | |
|---|---|---|---|---|
| 5,741,171 | A | 4/1998 | Sarfaty et al. | 451/6 |
| 5,791,973 | A * | 8/1998 | Nishio | 451/41 |
| 5,904,608 | A | 5/1999 | Watanabe | |
| 5,921,853 | A * | 7/1999 | Nishio | 451/289 |
| 5,961,369 | A | 10/1999 | Bartels et al. | |
| 6,074,276 | A | 6/2000 | Shibata et al. | |
| 6,136,043 | A * | 10/2000 | Robinson et al. | 8/485 |

(Continued)

FOREIGN PATENT DOCUMENTS

| | | |
|---|---|---|
| EP | 885691 | 12/1998 |
| JP | 9-85620 | 3/1997 |
| JP | 2001-25851 | 1/2001 |

*Primary Examiner*—Timothy V. Eley
(74) *Attorney, Agent, or Firm*—Wenderoth, Lind & Ponach, L.L.P.

(57) ABSTRACT

A polishing apparatus comprises a polishing tool having a polishing surface, and a holder device (top ring) for holding a semiconductor wafer (a substrate). The polishing apparatus further comprises a color CCD camera for taking a color image of a region on the polishing surface; an image processor for determining whether or not any foreign matter exists on the polishing surface based on a condition of a color in color image data acquired by the color CCD camera; and an apparatus operation control section which in response to determination of the image processing section, stops relative movement between the semiconductor wafer and the polishing surface and separates the top ring and the polishing surface from each other.

8 Claims, 5 Drawing Sheets

U.S. PATENT DOCUMENTS 6,293,846 B1 9/2001 Oguri ..... 451/6
6,328,629 B1 12/2001 Togawa et al.
6,634,924 B1 10/2003 Ono et al.
6,650,408 B2 * 11/2003 Jun et al. ..... 356/237.2
7,027,640 B2 * 4/2006 Park et al. ..... 382/152
7,072,034 B2 * 7/2006 Rosengaus et al. ..... 356/237.5

* cited by examiner

POLISHING APPARATUS AND METHOD FOR DETECTING FOREIGN MATTER ON POLISHING SURFACE

FIELD OF THE INVENTION

The present invention generally relates to a polishing apparatus, and more particularly, to a polishing apparatus capable of detecting foreign matter on a polishing surface, which might be produced especially by a slip-out event of a substrate during a polishing process, and also to a method for detecting foreign matter on a polishing surface.

DESCRIPTION OF THE PRIOR ART

Conventionally, a polishing apparatus has been commonly employed as an apparatus for producing a planar surface of a semiconductor substrate. This type of polishing apparatus has a configuration in which a substrate held by a top ring (a substrate holder device) is pressed against a polishing surface of a polishing pad mounted on a top surface of a turntable, and then the substrate and the polishing surface are slidably moved relative to each other while supplying a slurry containing abrasive grains onto the polishing surface, thus to polish a surface, to be polished, of the substrate.

In the polishing apparatus having the above configuration, sometimes it happens that the substrate slips or jumps out from the top ring during polishing. In such an event, if a polishing operation is continued without taking an appropriate remedying action, not only would this slipped-out substrate break, but also the polishing apparatus may be damaged. More disadvantageously, in case of breakage of the substrate, removal of broken pieces of the substrate and re-conditioning of the polishing pad may be required before restarting a polishing process; leading to a significantly low rate of productivity.

In order to deal with such a situation, a camera is used for taking an image of the polishing surface of the polishing pad, and acquired image data is processed by which it is possible to detect a slip-out event of the substrate, or existence of any foreign matter on the polishing pad, so that if either of these two conditions is detected, a polishing process may be suspended.

However, a conventionally available camera employed for the above-mentioned purpose is a monochrome camera, with which detection of foreign matter cannot be ensured in a case, for example, when a color of the polishing surface and a color of the foreign matter are different from each other but both have similar brightness, thus resembling each other in tone and lacking in contrast. Especially for a polishing pad having a polishing surface of a dark color (e.g., a black polishing surface), it has been difficult to detect a slipped out substrate that might be a semiconductor substrate.

SUMMARY OF THE INVENTION

The present invention has been made in light of problems as pointed out above, and an object thereof is to provide a polishing apparatus capable of detecting an existence of any foreign matter on a polishing surface in a more reliable manner, and a method thereof.

In order to solve the above problems, according to an aspect of the present invention, a polishing apparatus comprising a polishing surface and a substrate holder device for holding a substrate and pressing the substrate against the polishing surface, with a surface to be polished of the substrate brought into contact with the polishing surface, in which the substrate can be polished by a relative movement between the substrate and the polishing surface, is provided. The polishing apparatus further comprises a color camera for taking an image of a region on the polishing surface defined in the vicinity of the substrate holder device, and an image processing section for determining whether or not foreign matter exists on the polishing surface based on a condition of a color in a set of image data acquired by the color camera.

According to another aspect of the present invention, a polishing apparatus characterized in that an image processing section comprises: an identifying device for identifying whether or not a color of each point in image data represents a color of foreign matter; and a determination device which determines that foreign matter exists if a total area of those points having colors screened and identified to represent the foreign matter is larger than a predetermined threshold value, is provided.

According to another aspect of the present invention, a polishing apparatus characterized in that an image processing section comprises: a screening device for screening to identify whether or not a color of each point in a set of image data is identical with a color of foreign matter, which has been previously stored as a reference color, or identical with a color representative of a polishing surface; and a determination device which determines that foreign matter exists if either an area corresponding to the reference color or an area not corresponding to the reference color goes beyond a corresponding predetermined threshold value, is provided.

According to still another aspect of the present invention, a polishing apparatus is provided, which is characterized in further comprising an apparatus operation control section, which in response to determination of the image processing section that foreign matter exists, stops relative movement between a substrate and the polishing surface and separates the substrate holder device and the polishing surface from each other.

According to another aspect of the present invention, a detection method is provided, for detecting foreign matter on a polishing surface during a polishing process where a substrate is being polished by relative movement between the substrate and the polishing surface while pressing the substrate against the polishing surface, with the method comprising steps of: taking an image of a predetermined region on the polishing surface by using a color camera; screening to identify whether or not a color of each point in a set of image data taken by the color camera is identical with a color of foreign matter, which has been previously stored as a reference color, or identical with a color representative of the polishing surface; and determining that foreign matter exists if either an area corresponding to the reference color, or an area not corresponding to the reference color, goes beyond a corresponding predetermined threshold value.

Figure 1:
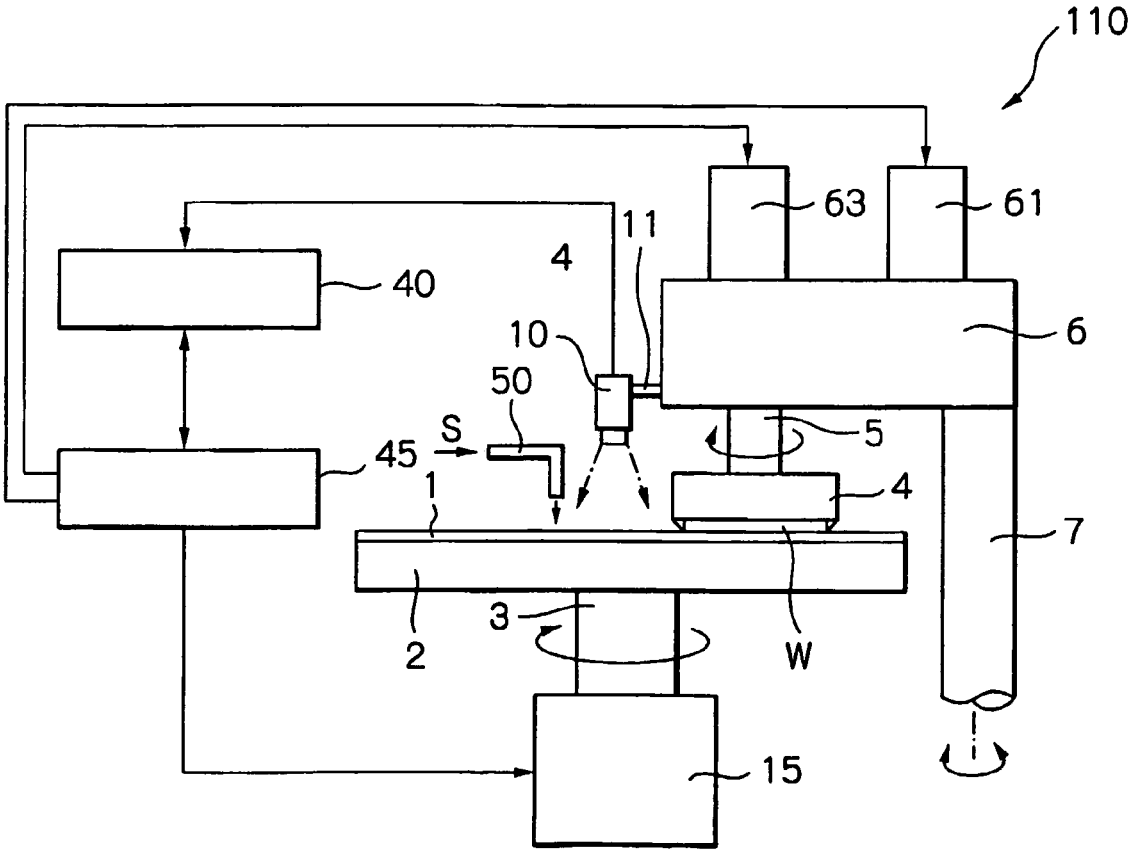
FIG. 1 is a schematic front view illustrating main components of a polishing apparatus.

In the drawings, reference numeral 110 (110*a*, 110*b*) designates a polishing apparatus, 1 a polishing tool, 2 a turntable (polishing table), 3 a table turning shaft, 4 a top ring (substrate holder device), 5 a top ring turning shaft, 6 a top ring swing arm, 7 a swing arm turning shaft, 10 a color CCD camera (a color camera), 40 an image processing section, 45 an apparatus operation control section, 50 an abrasive liquid supply pipe, symbol "S" an abrasive liquid (a slurry) and "W" a semiconductor wafer (a substrate), respectively.

DESCRIPTION OF THE PREFERRED EMBODIMENTS

An exemplary chemical and mechanical polishing plant (CMP plant) equipped with a polishing apparatus and a cleaning unit will now be described, which represents one application of the present invention.

Figure 5:
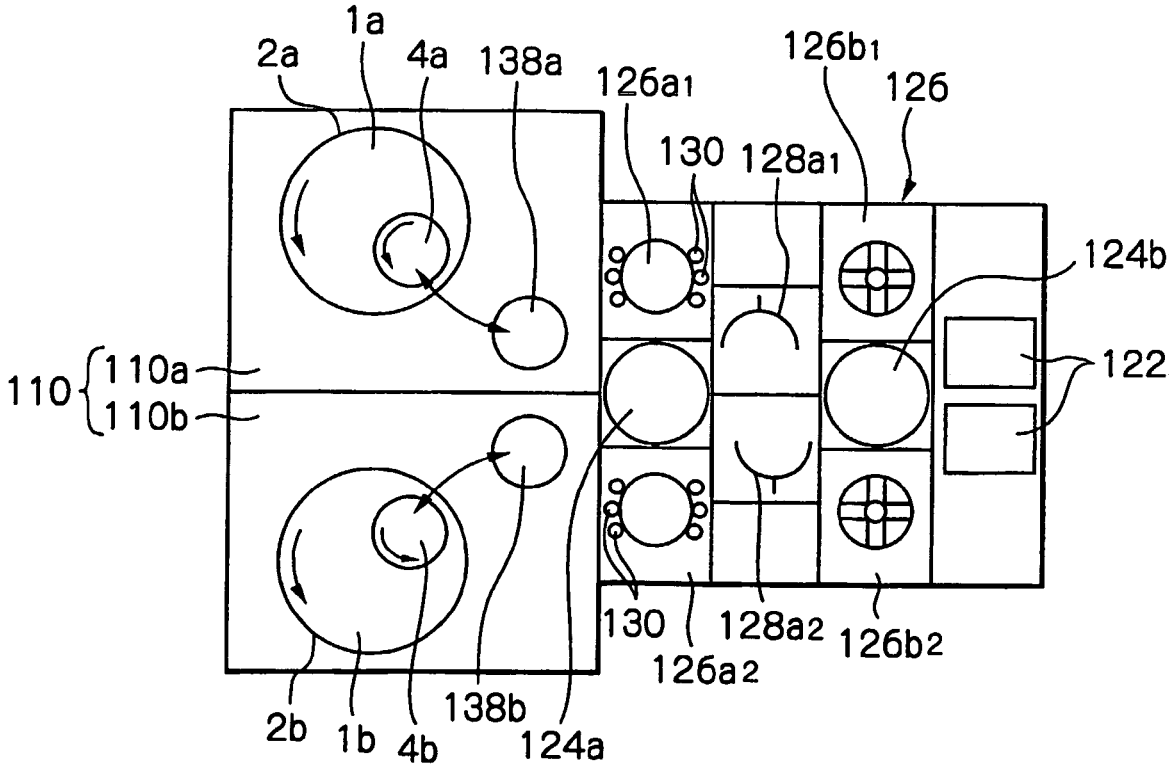
FIG. 5 is a general schematic view illustrating an example of configuration of a polishing apparatus equipped with a cleaning unit.

FIG. 5 is a general schematic view illustrating an example of a polishing plant of this type. Polishing plant 110 comprises, as shown in FIG. 5, a pair of similarly configured polishing apparatuses 110*a*, 110*b* which are located symmetrically on left and right sides of the plant. A cleaning unit 126 includes a pair of primary cleaning machines 126*a*1, 126*a*2, a pair of secondary cleaning machines 126*b*1, 126*b*2, and a pair of turn-over machines 128*a*1, 128*a*2, respectively, which are located symmetrically on the left and the right sides corresponding to respective polishing apparatuses 110*a*, 110*b*, and further includes two transfer equipments 124*a*, 124*b*. In addition, two load and unload stations 122, 122 are arranged symmetrically on the left and the right sides, respectively.

The polishing apparatus 110*a*, 110*b* comprises a turntable (a polishing table) 2*a*, 2*b* and a top ring 4*a*, 4*b* for pressing a semiconductor wafer held on an under surface thereof against the turntable 2*a*, 2*b* so as to polish the wafer.

In the polishing apparatus having such a configuration as described above, a semiconductor wafer is transferred by the transfer equipments 124*a*, 124*b* from load and unload station 122 to a delivery table 138*a* (or 138*b*) to be sucked there onto the under surface of the top ring 4*a* (or 4*b*), which is in turn moved to a position above the turntable 2*a* (or 2*b*). A polishing tool 1*a*, 1*b*, such as a polishing pad or a bonded abrasive having a polishing surface formed on a top surface thereof, is mounted on a top of the turntable 2*a*, 2*b*. Then, while supplying a specified abrasive liquid (in specific, for polishing an insulation film (an oxide film) on a silicon wafer, the abrasive liquid of alkaline aqueous solution with abrasive grain particles having a specified particle size suspended therein), and also while rotating the turntable 2*a* (or 2*b*) and the top ring 4*a* (or 4*b*) respectively, the semiconductor wafer is pressed against the polishing surface thus to polish the semiconductor wafer. After having been finished with this polishing process, the semiconductor wafer is passed through a cleaning and a drying process and delivered back to the load and unload station 122.

The primary cleaning machine 126*a*1, 126*a*2 is a low speed rotary type cleaning machine in which a plurality of vertical rollers 130 is arranged surrounding the wafer, and the wafer is held at an outer periphery thereof by grooves formed on upper peripheries of the rollers 130 so that the wafer may be driven to rotate by rotation of the rollers 130, wherein cleaning members made of sponge in the form of a roller or a pencil are provided so as to come into contact with and to be retracted from the wafer from above and below directions. The secondary cleaning machine 126*b*1, 126*b*2 is a high speed rotary type cleaning machine having a wafer gripping arm extending radially from a top end of a turning shaft.

After the above-discussed polishing process, a cleaning process is performed in the following manner. First, in the primary cleaning machine 126*a*1 (or 126*a*2), the wafer is subjected to scrub cleaning in which the wafer is scrubbed with cleaning polishing members to be cleaned while being rotated, and also supplied with a cleaning liquid over top and bottom surfaces thereof.

Then, in the secondary cleaning machine 126*b*1 (or 126*b*2), the wafer is further cleaned and subsequently subjected to a drying process by a high speed spinning of the secondary cleaning machine. After having finished with these cleaning and drying processes, the wafer is returned to the load and unload station 122 by a clean hand of the transfer equipment 124*b*.

Two different types of operation may be performed selectively in the above described facility of polishing apparatus: one is a parallel operation in which two polishing apparatuses 110*a*, 110*b* provide a polishing process independently from each other for wafers supplied thereto respectively, and the other is a serial operation in which a single wafer is transferred through the two polishing apparatuses 110*a*, 110*b* sequentially so as to be subjected to different polishing processes therein respectively.

In the parallel operation, in which each of the polishing apparatuses 110*a*, 110*b* functions independently for providing both a regular polishing and a finishing polishing, a water polishing operation in which only water is supplied rather than an abrasive liquid may be performed at different timings between the respective polishing apparatuses 110*a*, 110*b* so that the transfer equipments 124*a*, 124*b* may transfer the semiconductor wafer in an efficient manner.

Since this polishing facility comprises two polishing apparatuses 110*a* and 110*b* as well as the primary and the secondary cleaning machines 126*a*1, 126*a*2, 126*b*1 and 126*b*2, two separate wafer processing lines may be established: one is a first wafer processing line providing sequential steps comprising a polishing process by using the polishing apparatus 110*a*, a primary cleaning process by using the primary cleaning machine 126*a*1 and a secondary cleaning process by using the secondary cleaning machine 126*b*1, and the other is a second wafer processing line providing sequential steps comprising a polishing process by using the polishing apparatus 110*b*, a primary cleaning process by using the primary cleaning machine 126*a*2 and a secondary cleaning process by using the secondary cleaning machine 126*b*2, and therefore these semiconductor wafer transfer lines can be operated independently without interfering with each other, thus improving efficiency of a cleaning operation.

In the serial operation, after regular polishing has been applied to a semiconductor wafer by polishing apparatus 110*a*, the semiconductor wafer is transferred to the polishing apparatus 110*b*, where a water polishing operation is applied to the wafer. If there is no problem of contamination on the polishing apparatus, the semiconductor wafer may be transferred directly from polishing apparatus 110*a* to polishing apparatus 110*b* by transfer equipment 124*a*. If there is a problem of contamination, after the regular polishing having been applied to the semiconductor wafer in the polishing apparatus 110*a*, the semiconductor wafer should be transferred to primary cleaning machine 126*a*1 by transfer equipment 124*a* to be cleaned therein, and subsequently transferred to polishing apparatus 110*b*, where in turn the water polishing operation is applied to the semiconductor wafer.

In this case, any preferred chemicals may be selected depending on a type of slurry used in polishing apparatus 110*a*, so as to be added during a cleaning process in primary cleaning machine 126*a*1. In this serial operation, since the regular polishing operation and the water polishing operation are independently performed on separate turntables 2*a*, 2*b*, respectively, changing the polishing liquid to be supplied onto the turntable from an abrasive liquid to purified water and vice versa, is not necessary, thus preventing increase of loss time in operation as well as increase of consumption of the abrasive liquid and purified water.

The present invention further comprises a foreign matter detection device arranged in the above-described polishing apparatus 110 (110*a*, 110*b*), for detecting whether or not foreign matter exists on the polishing surface due to a slip-out of a semiconductor wafer (a substrate) while being polished.

FIG. 1 is a schematic front view illustrating main components of polishing apparatus 110. As shown in FIG. 1, polishing apparatus 110 comprises a turntable (a polishing table) 2, a top ring (a substrate holder device) 4, a color CCD camera 10, an image processing section 40 for processing a set of image data acquired by the camera, and an apparatus operation control section 45 for controlling an overall operation of the polishing apparatus 110. Each of these components will be described below.

The turntable 2 is of a disc-like shape and has a table turning shaft 3 mounted in a central location on a lower surface thereof, and further has a turntable driving section 15 below the table turning shaft 3, which drives the turntable 2 to rotate via the table turning shaft 3. A polishing tool 1 formed by, for example, a polishing pad or a bonded abrasive (abrasive grains bonded by using a resin binder) is mounted on a top surface of the turntable 2.

The top ring 4 has a top ring turning shaft 5 mounted in a central location on a top surface thereof with an upper portion of the top ring turning shaft 5 inserted into a top ring swing arm 6, so that the top ring 4 may be driven to rotate and/or to move up and down by a top ring rotary driving device 61 and a top ring vertical driving device 63, each arranged on the top ring swing arm 6. The top ring swing arm 6 is designed to be swung by a swing arm turning shaft 7. This means that the top ring 4 is operatively designed so as to move freely between a delivery table 138 (a, b) and the turntable 2 (a, b) shown in FIG. 5 with aid of the swing arm turning shaft 7. In addition, an abrasive liquid supply pipe 50 for supplying an abrasive liquid (a slurry) S is arranged above the turntable 2.

The color CCD camera 10 is attached on a side wall of the top ring swing arm 6 by an arm 11 so as to be positioned in the vicinity of a side portion of the above-described top ring 4. Due to this arrangement, color CCD camera 10 is able to take an image of a region on the polishing surface of turntable 2 in the vicinity of top ring 4 during a polishing process. Preferably, color CCD camera 10 may be installed in this specified position above turntable 2 located downstream with respect to rotation thereof, where semiconductor wafer W is more likely to slip out. If color CCD camera 10 is fixedly attached to top ring swing arm 6 in a manner discussed above so as to be swung therewith, with the top ring swing arm 6 serving as a swing motion mechanism for top ring 4, then even in such a case that polishing is performed while swinging top ring 4, advantageously an image-taking position of color CCD camera 10 may be normally fixed with respect to top ring 4. It is a matter of course that color CCD camera 10 may be operatively mounted to other mounting structure, such as an arm independently arranged separately from the top ring 4, so that this mounting structure may be swung to position color CCD camera 10 in the vicinity of a side portion of top ring 4.

Image processing section 40 is designed so as to receive image data of the polishing surface acquired by color CCD camera 10, to determine whether or not any foreign matter exists in a region acquired as an image, and then to output this result of determination to apparatus operation control section 45.

Apparatus operation control section 45 controls an overall operation of polishing apparatus 110, and specifically, it provides an independent control of the number of revolutions for turntable 2 and top ring 4, and in addition it also controls a pressure force of semiconductor wafer W against the polishing surface by moving top ring 4 up or down, a swing motion of top ring swing arm 6 and/or an amount of supply of slurry S.

Next, a detection method of foreign matter on a polishing surface during a polishing process of a substrate by polishing apparatus 110 will be described in detail.

Figure 2:
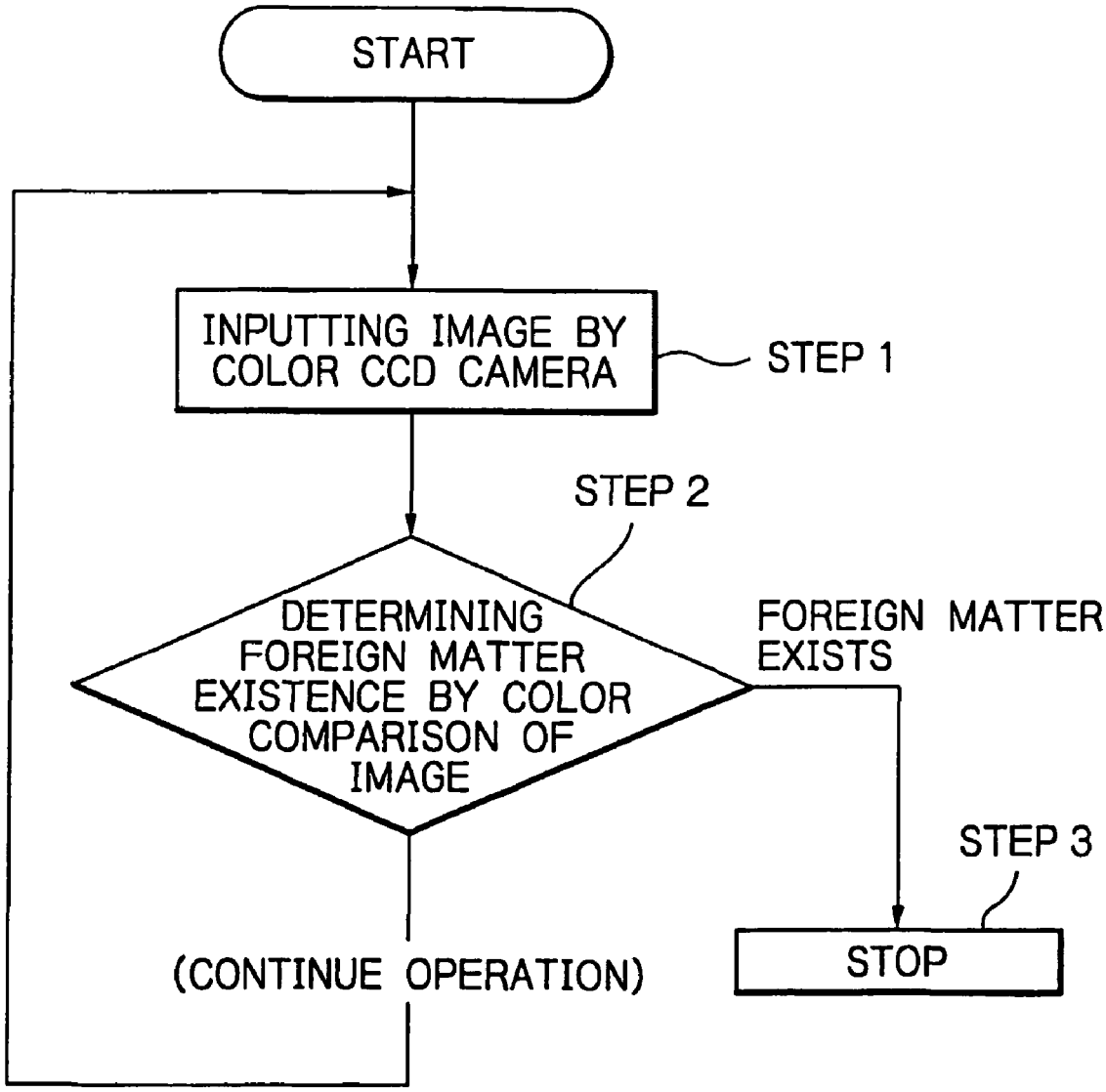
FIG. 2 is a general flow diagram showing an example of a foreign matter detection method.

FIG. 2 is a general flow diagram showing a method for detecting a slip-out event of semiconductor wafer W during a polishing process by using above-described color CCD camera 10 or the like. Semiconductor wafer W held on the under surface of top ring 4 in a manner as described above is brought into contact with the polishing surface of polishing tool 1 and polished by rotating motions of top ring 4 and turntable 2, while during this period, image processing section 40 receives images acquired by color CCD camera 10 at a rate of some ten times to some hundred times per second (Step 1), and determines whether or not any foreign matter, typically a part of semiconductor wafer W which has slipped out of the top ring 4, exists on the polishing surface based on a specified determination method (Step 2).

Specifically, the determination method includes, for example, the following methods:

(Determination Method 1)

First of all, a color representative of semiconductor wafer W, which will be determined as the foreign matter, should have been input and stored in advance as a reference color. Image processing section 40 compares a color of each point in the image of the image data received from color CCD camera 10 with the reference color individually so as to identify that the color of the point represents the color of the foreign matter or the color of the polishing surface. Then, in the image at a certain moment, when an area of points (a surface area formed by the points) identified to represent the color of the foreign matter has extended to be ultimately larger than a previously determined specific area (a threshold value), image processing section 40 determines that foreign matter exists on the polishing surface.

Figure 4:
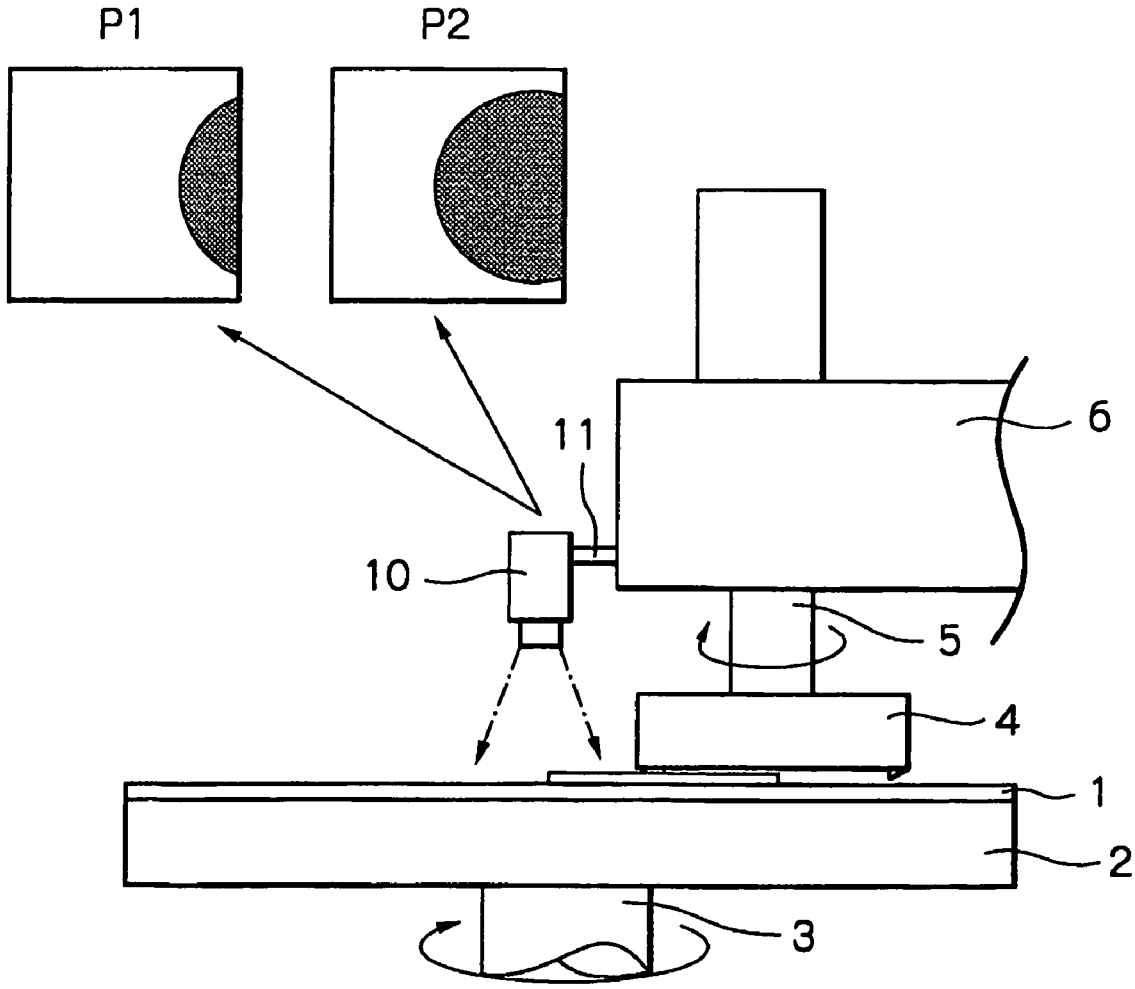
FIG. 4 is a schematic diagram illustrating a specific method for detecting foreign matter on a polishing surface.

That is, as shown in FIG. 4 by way of example, in the image data at a certain moment received from color CCD camera 10, if an area of points screened out to be identified as foreign matter (the area painted into black) is not larger than a predetermined specific area (the threshold value) as represented by image P1, then image processing section 40 determines that there is no foreign matter. On the other hand, if the area of the points screened out to be identified as the foreign matter (the area painted into black) has extended to be finally larger than the predetermined specific area (the threshold value) as represented by image P2, then image processing section 40 determines that the foreign matter exists on the polishing surface.

If the above-described specific area is set to be small, then detection sensitivity will be enhanced but there may be a possibility of an erroneous detection due to wrong identification. An optimal set area may be varied depending on a range of the image acquired by color CCD camera 10, a size of semiconductor wafer W, and a relationship between frequency of image processing and a number of revolutions of turntable 2, and preferably the set specific area should be around one half of the total area of semiconductor wafer W. Further, preferably the reference color should be set to have a width of color (a certain range of wave length) rather than a single color, whereby a more stable screening and determination can be provided.

Although in the above-discussed determination method, it is determined that foreign matter exists on the polishing surface when the area of the points screened out to be identified as the foreign matter has extended over the predetermined threshold value, the area of the foreign matter should not be necessarily a criterion, but alternatively image processing section 40 may determine that foreign mater exists when an area, which has not been screened out as the foreign matter, has been reduced to be ultimately smaller than a predetermined area (a threshold value).

(Determination Method 2)

The color of the semiconductor wafer representing foreign matter has been set and stored in determination method 1, but determination method 2 employs instead a color of the polishing surface to be set and stored as the reference color. In this case also, image processing section 40 compares a color of each one of points making up an image of image data received from color CCD camera 10 with the reference color individually, and during this comparison, image processing section 40 determines a point having the color from among the reference color to be foreign matter.

Then, similarly to determination method 1, in the image at a certain moment, when an area of the points screened out to be identified as foreign matter has extended to be ultimately larger than a predetermined specific area (threshold value), image processing section 40 determines that the foreign matter exists on the polishing surface. Preferably, the reference color should be set to cover a certain range of color. An area of the foreign matter should not necessarily be a criterion, but alternatively image processing section 40 may determine that foreign matter exists when an area, which has not been screened out as the foreign matter, has been reduced to be ultimately smaller than a predetermined area (the threshold value).

It is to be appreciated that since generally slurry S is being supplied during polishing of a substrate and this may change a color of the polishing surface, in this determination method, the reference color should be set also by taking a color of the slurry S (the color of the polishing surface changed by the supplied slurry S) into consideration. There will be also a case where the color of the polishing surface is changed when slurry S is replaced by purified water for performing, what is called, water polishing or when slurry S is changed from one type to another during polishing, depending on a polishing process applied.

In either case, each of different colors of the polishing surface generated by supply of respective different slurries S should have been set in advance as the reference color, and in a case of starting, switching or stopping of supply of slurry S under control of apparatus operation control section 45, apparatus operation control section 45 may output a signal indicative of the operation to image processing section 40 so as to switch the reference color from one color to another to be used in determination by image processing section 40 so that image processing section 40 may make a correct determination on whether or not foreign matter exists on a basis of this newly changed reference color. This may enable a stable detection of foreign matter.

(Determination Method 3)

Figure 3:
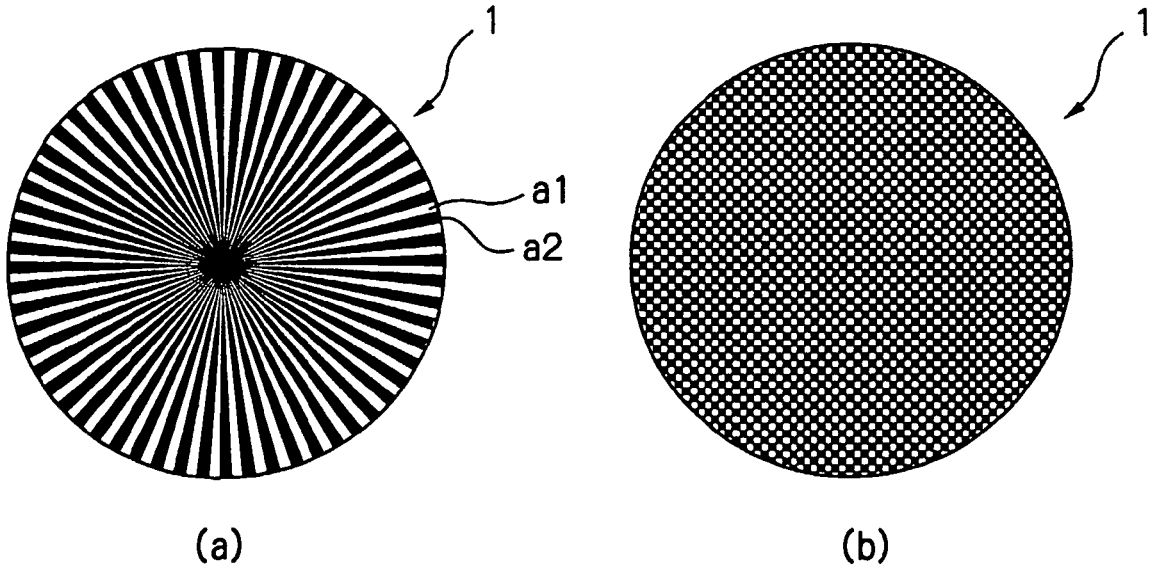
FIG. 3(*a*) and FIG. 3(*b*) show polishing surfaces of a polishing tool, respectively, represented in a two-color pattern.

Determination method 3 employs polishing tool 1 having a polishing surface patterned with two different colors. For example, a color of the polishing surface of polishing tool 1 may have a color pattern of radial lines in two different colors consisting of bright color areas a1 and dark color areas a2 arranged alternately as shown in FIG. 3(*a*), or a color pattern of a check pattern as shown in FIG. 3(*b*). Either pattern is represented by black and white in the drawings, but preferably actual colors should be chromatic colors. Each element of the above-described patterns should be made small enough in comparison with a range of an image taken by color CCD camera 10 so that a ratio of a total area occupied by one color in the image acquired during rotation of turntable 2 to that occupied by the other color may change little or may be approximately constant. Alternatively, a pattern formed to be parallel with a proceeding direction of the polishing surface, or a coaxial circular pattern for the turntable, may be employed to eliminate substantially a change in ratio of one color to the other color otherwise caused by movement of the polishing surface.

These two colors in the pattern should have been set and stored in advance as reference colors in image processing section 40, and a total area of each one of the reference colors occupying an image at a certain moment is determined respectively. In determination of whether or not foreign matter exists, it is determined that the foreign matter exists when either one of areas of two different colors has fallen out of a range of the change in area due to the rotation of turntable 2, to be smaller than a specified area. If a color of the polishing surface is similar to a color of the foreign matter, there will be a possibility that determination of whether or not foreign matter exists is uncertain, but according to this method using two different reference colors, foreign matter of any color would be apparently different from at least either one of the two different reference colors, and so detection can be performed with higher reliability. In this case also, preferably each reference color should be set to cover a certain range of color.

Three different determination methods have been described as embodiments of the present invention, and since all three methods according to the present invention employ a color camera as an image taking device, each one of points in an image acquired by the color camera contains an individual set of gradient data for each one of three primary colors. Owing to this, each of the gradient data may be compared individually and thereby a difference in color pertaining to an object can be detected, which could not have been detected through a comparison of brightness in a black and white image or a monotone monochrome image.

Referring again to FIG. 2, when the image processing section 40 has determined that no foreign matter exists according to one of the above-described determination methods, operation of polishing apparatus 110 is continued and the above-discussed determination process (Step 1 and Step 2) may be sequentially repeated.

On the contrary, when image processing section 40 has determined that foreign matter exists according to one of the above-described determination methods, a signal indicative of that determination is sent from image processing section 40 to apparatus operation control section 45, which in response to this, stops immediately a polishing operation in order to prevent damage to semiconductor wafer W as well as to polishing apparatus 110. (Step 3). Specifically, rotating motions of turntable 2 and top ring 4 are stopped, and top ring 4 is lifted to separate from polishing tool 1. Further, any alarm sounds or alarm signals may be sent to a central control room in a semiconductor manufacturing plant.

It is to be noted that as is the case with a polishing apparatus equipped with the cleaning unit shown in FIG. 5, if the facility of polishing apparatus 110 (110*a*, 110*b*) comprises a plurality of turntables 2 (2*a*, 2*b*) and a plurality of top rings 4 (4*a*, 4*b*), and/or comprises a built-in cleaning unit (cleaning and drying unit 126), only operation of the polishing apparatus in concern (for example, apparatus 110*a*) may be stopped but polishing apparatus (110*b*), cleaning unit 126 and related structure may continue their specified operations.

Although the present invention has been illustrated and described with reference to the preferred embodiments, the present invention is not limited to those embodiments, and many different variations may be made without departing from the scope of the disclosure in the claims and the technical concept described in this specification and the attached drawings. It is to be noted that other shapes and structures, which are not directly illustrated in the specification and drawings but can achieve an operation and/or effect of the present invention, are intended to fall within the scope of the technical concept of the present invention.

For example, although polishing apparatus 110 using rotary turntable 2 has been illustrated in the above embodiments, it is needless to say that the present invention is applicable to such a polishing apparatus having a configuration in which a substrate is pressed against a polishing belt moving linearly. Thus, the present invention is applicable to a polishing apparatus of any configuration so long as it comprises a polishing surface and a substrate holder device, in which a substrate held by the substrate holder device is pressed against the polishing surface, with a surface to be polished of the substrate brought into contact with the polishing surface, and then the substrate and the polishing surface are driven to make a relative movement to each other so as to polish the substrate.

Although the description in the above embodiment has been directed to an example for detecting semiconductor wafer W slipped out of top ring 4 as foreign matter, it is needless to say that the present invention is applicable to detection of a variety of types of foreign matter other than the semiconductor wafer.

Although the number of colors used is two in the above determination method 3, three or more colors may be used, and in this case those three or more colors (or a specified number of colors selected from among them) may be used as reference colors for determination of foreign matter.

EFFECT OF THE INVENTION

According to the present invention, as described above in detail, since a color camera has been employed as a camera used to take an image of a polishing surface, and each one of points in an acquired image contains a set of color gradient data for each one of three primary colors, which will be compared individually, a difference in color pertaining to an object can be detected more precisely, which could not have been achieved in a conventional comparison of contrast, and advantageously, existence of any foreign matter can be detected in a more reliable manner, thus providing a superior effect in ensuring that both of a substrate and polishing apparatus can be protected from possible damage.

The invention claimed is:

1. A polishing apparatus comprising:

a polishing surface;

a substrate holder for holding a substrate and pressing a surface of the substrate against said polishing surface while said substrate holder and said polishing surface move relative to one another so as to polish the surface of the substrate;

a camera for acquiring color image data of a region of said polishing surface;

an image processor for determining whether or not foreign matter exists on said polishing surface based on a color condition of the color image data as acquired by said camera, said image processor including (i) identifying means for identifying whether or not a color of each point in the color image data as acquired by said camera is identical with a color of foreign matter, which color of foreign matter has been previously stored as a reference color, and (ii) determination means for determining existence of foreign matter when a total area of points, each of which corresponds to the reference color, exceeds a predetermined threshold value.

2. The polishing apparatus according to claim 1, further comprising:

a control unit for outputting a signal to switch the reference color to another color.

3. The polishing apparatus according to claim 2, further comprising:

plural types of polishing liquids to be supplied to said polishing surface, wherein said control unit is also for controlling which of the plural types of polishing liquids is to be supplied to said polishing surface, with said control unit being for outputting the signal to switch the reference color to another color based which of the plural types of polishing liquid is to be supplied to said polishing surface.

4. The polishing apparatus according to claim 1, wherein the predetermined threshold values depends on a range of the color image data as acquired by said camera, a size of the substrate, or a relationship between frequency of processing the color image data and a number of revolutions of said polishing surface, and said reference color has a width of color.

5. A method for detecting foreign matter on a polishing surface, while polishing a substrate by pressing the substrate against the polishing surface and moving the substrate and the polishing surface relative to one another, said method comprising:

acquiring color image data of a predetermined region on said polishing surface by using a camera;

identifying whether or not a color of each point in said color image data acquired by said camera is identical to a color of foreign matter, which color of foreign matter has been previously stored as a reference color; and determining that foreign matter exists (i) when a total area of points, each of which corresponds to said reference color, exceeds a first predetermined threshold value, or (ii) when a total area of points, each of which does not correspond to said reference color, decreases to less than a second predetermined threshold value.

6. The method according to claim 5, wherein either of the first or second predetermined threshold values depends on a range of said color image data acquired by said camera, a size of said substrate, or a relationship between frequency of processing said color image data and a number of revolutions of said polishing surface, and said reference color has a width of color.

7. A polishing apparatus comprising:

a polishing surface;

a substrate holder for holding a substrate and pressing a surface of the substrate against said polishing surface while said substrate holder and said polishing surface move relative to one another so as to polish the surface of the substrate;

a camera for acquiring color image data of a region of said polishing surface; and an image processor for determining whether or not foreign matter exists on said polishing surface based on a color condition of the color image data as acquired by said camera, said image processor including (i) identifying means for identifying whether or not a color of each point in the color image data as acquired by said image processor is a color of foreign matter, and (ii) determination means for determining existence of foreign matter when a predetermined threshold value is exceeded by a total area of points, each of which is the color of foreign matter.

8. A polishing apparatus comprising:

a polishing surface;

a substrate holder for holding a substrate and pressing a surface of the substrate against said polishing surface while said substrate holder and said polishing surface move relative to one another so as to polish the surface of the substrate;

a camera for acquiring color image data of a region of said polishing surface;

an image processor for determining whether or not foreign matter exists on said polishing surface based on a color condition of the color image data as acquired by said camera, said image processor including (i) identifying means for identifying whether or not a color of each point in the color image data as acquired by said camera is identical with a color of foreign matter, which color of foreign matter has been previously stored as a reference color, and (ii) determination means for determining existence of foreign matter when a total area of points, each of which does not correspond to the reference color, decreases to less than a predetermined threshold value.

* * * * *